United States Patent [19]

Selwood

[11] 4,342,812

[45] Aug. 3, 1982

[54] STENTERED, BONDED, HEAT-SET, NON-WOVEN FABRIC AND PROCESS FOR PRODUCING SAME

[75] Inventor: Alan Selwood, Heighington, nr. Darlington, England

[73] Assignee: Imperial Chemical Industries Limited, England

[21] Appl. No.: 213,119

[22] Filed: Dec. 4, 1980

[30] Foreign Application Priority Data

Dec. 7, 1979 [GB] United Kingdom ..... 7942317

[51] Int. Cl.[3] ..... B32B 31/08; B32B 31/12; B32B 31/16; B32B 31/26

[52] U.S. Cl. ..... 428/286; 156/73.1; 156/73.5; 156/93; 156/229; 156/281; 156/290; 156/291; 428/287; 428/288; 428/296; 428/298

[58] Field of Search ..... 28/122; 156/73.1, 73.5, 156/93, 229, 281, 290, 291; 428/286, 287, 288, 296, 298

[56] References Cited

U.S. PATENT DOCUMENTS 3,523,059 8/1970 Coates .
3,531,347 9/1970 Stultz .

FOREIGN PATENT DOCUMENTS 1105968 11/1964 United Kingdom .
1324661 7/1973 United Kingdom .
1345179 1/1974 United Kingdom .
1352924 5/1974 United Kingdom .
1418227 12/1975 United Kingdom .
1558402 1/1980 United Kingdom .

*Primary Examiner*—James C. Cannon
*Attorney, Agent, or Firm*—Scully, Scott, Murphy & Presser

[57] ABSTRACT

A process for producing a non-woven fabric and fabric produced thereby, the process comprising (1) forming a stack of three or more superimposed fibrous shims, in at least one of the shims the fibres being oriented predominantly in a first direction, corresponding to the machine direction of the shim, and in at least one of the other shims the fibres being oriented predominantly in a second direction, corresponding to the machine direction of the shim, which is inclined at an acute angle to an imaginary line which is orthogonal to the first direction, and in at least one of the other shims the fibres being oriented in a third direction, corresponding to the machine direction of the shim, which is inclined at an obtuse angle to an imaginary line which is orthogonal to the first direction, (2) bonding the fibrous shims together, (3) subjecting the bonded fabric so formed to a stentered operation in a direction orthogonal to the first direction which causes the bonded shims to expand orthogonally to the first direction and to contract in the first direction, and (4) heat setting the bonded shims while they are being stentered.

8 Claims, No Drawings

STENTERED, BONDED, HEAT-SET, NON-WOVEN FABRIC AND PROCESS FOR PRODUCING SAME

This invention relates to a non-woven fabric comprising a bonded stack of fibrous shims and to a process for producing such a fabric.

It is already known to produce a non-woven fabric comprising three or more superimposed fibrous shims in which the predominating direction of fibre orientation in the outermost shims is orthogonal to the predominating direction of fibre orientation in the other shims. Usually the predominating direction of fibre orientation in the outermost shims is in the machine or 'warp' direction and the predominating direction of fibre orientation in the other shims is in the 'weft' direction. In such a fabric the shims are bonded together in discrete areas.

Such fabrics have poor extensibility in the 'warp' direction.

It is also known to produce a bonded non-woven fabric comprising a four ply stack of fibrous shims in which the direction of fibre orientation in the first and second plies in the stack are the same and the direction of fibre orientation in the third and fourth plies in the stack are the same and at an angle to the direction of fibre orientation in the first and second plies.

In such a fabric, if the angle is 90°, then the fabric properties will be similar to those of the above 'orthogonal' fabrics. If the angle is substantially less than 90°, then the fabric will exhibit a weakness and a lack of recovery in the direction of the bisector of the angle complementary to the above-stated angle of fibre orientation.

According to the present invention we provide a process for producing a non-woven fabric comprising (1) forming a stack of three or more superimposed fibrous shims, in at least one of the shims the fibres being oriented predominantly in a first direction, corresponding to the machine direction of the shim, and in at least one of the other shims the fibres being oriented predominantly in a second direction (corresponding to the machine direction of the shim), which is inclined at an acute angle to an imaginary line which is orthogonal to the first direction, and in at least one of the other shims the fibres being oriented in a third direction (corresponding to the machine direction of the shim), which is inclined at an obtuse angle to an imaginary line which is orthogonal to the first direction, (2) bonding the fibrous shims together, (3) subjecting the bonded fabric so formed to a stentering operation in a direction orthogonal to the first direction which causes the bonded shims to expand orthogonally to the first direction and to contract in the first direction, and (4) heat setting the bonded shims while they are being stentered.

We also provide a heat-set, stentered, non-woven fabric comprising a bonded stack of three or more superimposed fibrous shims, in at least one of the shims, prior to stentering, the fibres being oriented predominantly in a first direction, corresponding to the machine direction of the shim, and in at least one of the other shims, prior to stentering, the fibres being oriented predominantly in a second direction (corresponding to the machine direction of the shim), which is inclined at an acute angle to an imaginary line which is orthogonal to the first direction, and in at least one of the other shims, prior to stentering, the fibres being oriented in a third direction (corresponding to the machine direction of the shim), which is inclined at an obtuse angle to the imaginary line, the fabric having been stentered in a direction orthogonal to the first direction.

In the process we prefer to use a stack of four or more fibrous shims, in the outermost shims the fibres being oriented predominantly in a first direction, corresponding to the machine direction of those shims, in at least one of the other shims the fibres being oriented predominantly in a second direction which is inclined at an acute angle to an imaginary line which is orthogonal to the first direction and in at least one of the other shims, the fibres being oriented in a third direction which is inclined at an obtuse angle to the imaginary line.

We also prefer that in the stack of shims, the second direction is at an angle of between +10° and +80°, more preferably at an angle of between +25° and +65°, and most preferably at an angle of between +35° and +55°, to an imaginary line which is orthogonal to the first direction, whilst the third direction is at an angle of between +100° and +170° more preferably at an angle of between +115° and +155° and most preferably at an angle of between +125° and +145° to the imaginary line.

The several shims may be formed into a stack in any suitable manner. For convenience each of the shims having a fibre orientation in the first direction are arranged in the stack in such a manner that the first direction, corresponding to the machine direction of the shim, corresponds to the machine direction of the non-woven fabric itself. Those of the shims having a fibre orientation in the second and third directions may then be introduced into the stack by a cross lapping technique or, alternatively by a cut and place technique. As a further alternative any or all of the shims in the stack may be introduced by a precision air-laying technique. Thus, for example, where the stack comprises four superimposed shims, the outermost shims having a fibre orientation in the first direction and the two inner shims having fibre orientations in the second and third directions, the innermost shims can be laid on one of the outermost shims by a cross lapping technique and the other outermost shim can then be laid on top of the cross lapped shim. When the stack includes more than one pair of shims having a fibre orientation in the second and third directions then each of these pairs of shims can be introduced into the stack by a cross lapping technique.

It will be realised that in shims which have been introduced into the stack by a cross lapping technique that the fibres in those portions of the shim which emanate from one longitudinal edge of the non-woven fabric will be inclined at a positive angle to the aforementioned imaginary line and that the fibres in those portions of the shim which emanate from the other longitudinal edge of the non-woven fabric will be inclined at a negative angle to the aforementioned imaginary line.

In this specification, unless otherwise indicated, the terms "fibres" and "fibrous shims" are used broadly to include both staple fibres and continuous filaments and shims thereof. Furthermore, it should be understood, that the fibres or filaments in a shim can be textured or untextured or may be potentially crimpable so that when the fabric is heat set the crimp in such fibres or filaments is developed.

When we use a term such as "the fibres in a shim are oriented predominantly in one direction" we mean that the fibres within the shim have a degree of parallelism in excess of 95% which is significantly higher than that obtained by a simple carding process as applied to staple fibres. This high degree of parallelism is characterised in staple shims by a fibre direction coherence of 1 g/cm/g/m$^2$, a cross fibre direction coherence of less than 0.2 g/cm/g/m$^2$ and a tweezer separation distance of at least 5 cm. Such an enhanced degree of parallelism of staple fibres may be obtained by subjecting a carded shim to an additional fibre orienting step during the carding operation. Continuous filament shims may be produced, for example, by arranging a number of spinnerets side-by-side and collecting the extruded filaments on a moving conveyor having means to maintain the required degree of predominant orientation of the fibres. Alternatively continuous filament shims may be produced by an air laying technique in which one or more continuous filaments are laid on a moving conveyor. As a further alternative a tow of continuous filaments can be opened to form a sheet of filaments using the threaded roll apparatus described in British Patent Specification No. 1,105,968.

It should be realised that in the stack of superimposed fibrous shims comprising the non-woven fabric, one or more shims may be a staple fibre shim and one or more shims may be a continuous filament shim.

In one embodiment of the invention the fibrous shim is produced by a process which consists of subjecting a plurality of staple fibre slivers including at least some potentially crimpable fibres to a treatment in which the slivers are spread and merged into a web and then subjected to a heat treatment. A process of this kind is described in British Patent Specification No. 1,558,402. In the process the slivers are led between at least three pairs of rollers which draft the fibres and spread and merge the slivers laterally into a single web which is then subjected to a heat treatment under conditions allowing some contraction of the fibres to effect crimping of the crimpable fibres and formation of a coherent highly ordered shim.

Fibre coherence in a staple shim is conveniently measured using a flexible tensile test machine such as the Instron machine. For both fibre and cross-fibre direction measurements a sample width of 2.5 cm equal to the width of the machine clamping jaws which are operated at a cross-head speed of 20 cm/min together with a chart speed of 10 cm/min. For fibre direction coherence samples having a length 1.5 times the nominal or mean fibre length plus the clamping length are cut and weighed carefully so as not to disturb the delicate fibre structure and then mounted in the test machine. For cross-fibre direction coherence measurements a test sample length of 1 cm (plus clamping length) is used and for both measurements the coherence is calculated from the measured breaking load as follows:

$$\text{Coherence} = \frac{B}{2.5} \times \frac{L}{100} \times \frac{W}{100} \times \frac{1}{M} \text{ g/cm/g/m}^2$$

where

B is the measured breaking load in grams.

L is the sample length in cm

W is the sample width in cm and

M is the sample weight in grams.

For measurement of tweezer separation distance stainless steel tweezers are selected measuring 13 cm end to end and 11 cm from the hinge point to the tweezer tips, the hinge resilience being such that there is 1 cm separation of the tips from beginning to end of a test. One limb of the tweezers is attached rigidly to the measuring arm of a rotary tensiometer for example of the "Zivy" type having a full scale deflection of 30 g. To effect a measurement the tweezer tips (sharpened to fine points if necessary), are inserted in the closed position into the shim sample to the specified depth, the sample having been suitably supported in a horizontal plane under slight tension. The tips are then allowed to open to 1 cm separation in the cross fibre direction and the gauge moved horizontally and parallel to the fibre direction along the web until the initial zero reading rises to 20 g. The distance moved in cm between these points is the tweezer separation distance which is approximately independent of shim weight at least for values in the range 40±10 g/m$^2$.

The fibres in the shim may be natural fibres or synthetic fibres derived from linear organic polymeric materials, as for example melt spinnable polyesters, polyamides and copolymers of such linear organic polymers. We prefer that at least some of the fibres in the shim are synthetic thermoplastic fibres since these allow the several shims to be bonded together by simple and effective thermal means and may be produced in both staple fibre and continuous filament forms and potentially crimpable forms, as for example bicomponent fibres in which at least part of one component present at the surface of the fibres is of lower softening or melting point and different shrinkage propensity than the other component.

The several fibrous shims in the stack may be bonded together in any suitable manner for example by thermal, ultrasonic or adhesive bonding or by stitching. We prefer, however, to effect point or segmental bonding of the shims by heat and pressure, for example by passing the stack of fibrous shims through the nip of a hot calender press, at least one roll of which bears a pattern of projections which corresponds to the desired pattern of bonded discs. Suitable bonded patterns are those in which the projections of the bonds onto the imaginary orthogonal line referred to above produces a continuous line thus trapping all fibres aligned in the first direction. However if the fibre directions in the outermost layers are not the same, then a bond arrangement which may be projected to produce a continuous line on two imaginary orthogonal lines (ie relative to the two outermost layers) is required. Preferably the bonded area should be between 5 and 25% and more preferably between 8 and 15% of the total area. The bond spacing should preferably be between 1 and 10 mm.

Preferably the bonded areas are arranged with their longitudinal axes orthogonal to the first direction.

The bonded fabric is subjected to a stentering operation which causes the bonded fabric to expand laterally, ie at right angles to the first direction, whilst at the same time causing contraction of the fabric in a lengthwise direction, ie in the first direction. This serves to reorientate those fibres in the bonded fabric which are oriented predominantly in the second direction into a direction which is orthogonal to the first direction.

Any suitable stenter may be used which allows lengthwise contraction of the fabric as lateral expansion takes place. A conventional stenter may be used in which case it will be necessary to overfeed the bonded fabric to the stenter ie by charging the fabric to the stenter at a faster rate than the rate at which the stenter operates. Alternatively a modified stenter may be used in which the stenter pins are attached to alternate links of a chain, for example a Renold chain, intervening links in the chain then being moved out laterally during the stentering operation so that lengthwise contraction and lateral expansion of the bonded fabric occurs.

While the fabric is being stentered it is heat set by heating the fabric to a temperature in excess of 100° C., the actual temperature used being dependent upon the chemical nature of the fibres used.

This may be achieved by the use of hot air, hot combustion products of natural gas or other fuel or by the use of superheated steam.

Heat setting of the fabric causes the fibre arrangement imposed during the stentering operation to be retained and preferred by the fabric after removal from the stenter pins. Thus the heatset fabric has a thick bulky appearance and a soft drapeable handle combined with a high degree of stretch in the first (ie warp) direction. Such a fabric can be used for many applications in the domestic, apparel and other textile fields.

The invention will now be described with reference to the following Examples:

EXAMPLES

A plurality of pieces of a fibrous shim were prepared from 100% staple fibre having a decitex of 3.3 and a staple length of 100 mm. The individual fibres were eccentric core/sheath (67/33), the core being composed of polyethylene terephthalate and the sheath being composed of 15 mole % polyethylene isophthalate/polyethylene terephthalate copolymer.

A continuous length of shim, 160 mm wide, was made by the method described in British Patent Specification No. 1,558,402 starting from 16 ends of 2 g/m sliver with an overfeed of 11 ∝ 17% and a crimping temperature of 175°-183° C. The shim had a nominal weight of 42 g/m$^2$. Using the continuous shim a plurality of sample pieces 1.8 m long × 1 m wide (6 × 160 mm wide shims) were prepared. A number of 4 ply laminates were prepared by hand laying four of the pieces on top of each other.

The laminates were thermally bonded on a calender at a speed of 3 m/min with either an ortho twill pattern or a diagonal twill pattern.

The ortho twill pattern was produced using a bottom roll pattern corresponding to a 45° right hand helic, the lands on which had a width of 0.14 cm and a separation of 0.19 cm and a roll pattern of splines of width 0.04 cm and a separation of 0.19 cm at a temperature of 195° C. and a pressure of 70 psi. The diagonal twill pattern was produced using a bottom roll pattern corresponding to a 45° right hand helix, the lands on which had a width of 0.14 cm and a separation of 0.19 cm.

Some of the prepared bonded laminates were subjected to a variety of physical tests. The remaining bonded laminates were subjected first to a stentering operation and then to a heat setting operation, such stentered/heat set laminates also being subjected to comparative tests.

| | PREPARATION OF LAMINATES | | | | | | |
|---|---|---|---|---|---|---|---|
| REF | ORIENTATION OF FIRST PLY | ORIENTATION OF SECOND PLY | ORIENTATION OF THIRD PLY | ORIENTATION OF FOURTH PLY | BOND PATTERNS | STENTERING | HEAT SETTING |
| 15/6A | First Direction | +30° | +150° | First Direction | Ortho Twill | None | None |
| 15/6B | First Direction | +30° | +150° | First Direction | Ortho Twill | 10% Stretch | 170° |
| 15/7A | First Direction | +45° | +135° | First Direction | Ortho Twill | None | None |
| 15/7B | First Direction | +45° | +135° | First Direction | Ortho Twill | 15% Stretch | 215° |
| 16/7A | First Direction | +45° | +135° | First Direction | Diagonal Twill | None | None |
| 16/7B | First Direction | +45° | +135° | First Direction | Diagonal Twill | 10% Stretch | 170° |

| | PHYSICAL TESTS | | | | | | | | |
|---|---|---|---|---|---|---|---|---|---|
| | | | TENSILE STRENGTH deca Newtons | | EXTENSION AT BREAK % | | WINGTEAR STRENGTH deca Newtons | | DRAPE WEFT |
| REF | WEIGHT G/M$^2$ | THICKNESS MM | WARP | WEFT | WARP | WEFT | WARP | WEFT | % |
| 15/6A | 191 | 0.7 | 45 | 17 | 46 | 27 | — | 0.8 | — |
| 15/6B | 206 | 1.6 | 47 | 19 | 73 | 14 | 3.7 | 1.9 | 56 |
| 15/7A | 189 | 0.6 | 49 | 6 | 40 | 40 | — | 2.9 | — |
| 15/7B | 202 | 2.3 | 52 | 12 | 80 | 31 | 3.8 | 3.7 | 69 |
| 16/7A | 180 | 0.5 | 55 | 5 | 30 | 32 | — | 3.1 | — |
| 16/7B | 189 | 1.3 | 60 | 5 | 48 | 23 | 8.2 | 1.1 | 57 |

NOTE:
In the above table relating to the preparation of laminates it should be noted that the second and third plies are oriented with respect to the imaginary line referred to previously.

I claim

1. A process for producing a non-woven fabric comprising (1) forming a stack of three or more superimposed fibrous shims, in at least one of the shims the fibres being oriented predominantly in a first direction, corresponding to the machine direction of the shim and in at least one of the other shims the fibres being oriented predominantly in a second direction, corresponding to the machine direction of the shim, which is inclined at an acute angle to an imaginary line which is orthogonal to the first direction, and in at least one of the other shims the fibres being oriented in a third direction, corresponding to the machine direction of the shim, which is inclined at an obtuse angle to an imaginary line which is orthogonal to the first direction, (2) bonding the fibrous shims together, (3) subjecting the bonded fabric so formed to a stentering operation in a direction orthogonal to the first direction which causes the bonded shims to expand orthogonally to the first direction and to contract in the first direction, and (4) heat setting the bonded shims while they are being stentered.

2. A process for producing a non-woven fabric as claimed in claim 1 in which a stack of four or more fibrous shims are used, in the outermost shims the fibres being oriented predominantly in a first direction, corresponding to the machine direction of the fabric, in at least one of the other shims the fibres being oriented predominantly in a second direction which is inclined at an acute angle to an imaginary line which is orthogonal to the first direction and in at least one of the other shims, the fibres being oriented in a third direction which is inclined at an obtuse angle to the imaginary line.

3. A process as claimed in either claim 1 or claim 2 in which the second direction is at an angle of between +10° and +80°, preferably between +25° and +65° and more preferably between ±° and +55°, to an imaginary line which is orthogonal to the first direction.

4. A process as claimed in either claim 1 or claim 2 in which the third direction is at an angle of between +100° and +170°, preferably between +115° and +155° and more preferably between +125° and +145°, to an imaginary line which is orthogonal to the first direction.

5. A heat-set, stentered, non-woven fabric comprising a bonded stack of three or more superimposed fibrous shims, in at least one of the shims, prior to stentering, the fibres having been oriented predominantly in a first direction, corresponding to the machine direction of the shim, and in at least one of the other shims, prior to stentering, the fibres having been oriented predominantly in a second direction, corresponding to the machine direction of the shim, inclined at an acute angle to an imaginary line orthogonal to the first direction, and in at least one of the other shims, prior to stentering, the fibres having been oriented in a third direction, corresponding to the machine direction of the shim, inclined at an obtuse angle to the imaginary line, the fabric having been stentered in a direction orthogonal to the first direction during heat setting.

6. A non-woven fabric as claimed in claim 5 in which all of the superimposed fibrous shims are staple fibre shims.

7. A non-woven fabric as claimed in claim 5 in which all of the superimposed fibrous shims are continuous filament shims.

8. A non-woven fabric as claimed in claim 5 in which one or more of the superimposed fibrous shims are staple fibre shims and one or more of the superimposed fibrous shims are continuous filament shims.

* * * * *

UNITED STATES PATENT AND TRADEMARK OFFICE

CERTIFICATE OF CORRECTION

PATENT NO. : 4,342,812

DATED : August 3, 1982

INVENTOR(S) : Alan Selwood

It is certified that error appears in the above-identified patent and that said Letters Patent are hereby corrected as shown below:

Column 4, line 37: "bonded discs" should be --bonded areas--;

Column 6, line 1: "11 ∝ 17%" should be --11-17%--.

Signed and Sealed this

*Twenth-eighth* Day of *September 1982*

[SEAL]

*Attest:*

GERALD J. MOSSINGHOFF

*Attesting Officer*

*Commissioner of Patents and Trademarks*